US005355754A

United States Patent [19]

Baker

[11] Patent Number: 5,355,754

[45] Date of Patent: Oct. 18, 1994

[54] CARPET SEAM CUTTER

[76] Inventor: Billy Baker, 5716 Tiger Trail, Fort Worth, Tex. 76126

[21] Appl. No.: 960,488

[22] Filed: Oct. 8, 1992

[51] Int. Cl.[5] ..... B26B 29/06

[52] U.S. Cl. ..... 83/679; 30/315

[58] Field of Search ..... 30/286, 315, 317, 289, 30/296.1; 7/103; 83/652, 697, 698

[56] References Cited

U.S. PATENT DOCUMENTS

| | | | |
|---|---|---|---|
| 178,035 | 5/1876 | Van Winkle | 83/698 |
| 1,663,092 | 3/1928 | Parys | 83/698 |
| 2,101,359 | 12/1937 | Bonner | 112/262 |
| 2,418,958 | 4/1947 | Stock | 30/296.1 |
| 3,120,083 | 2/1964 | Dahlberg et al. | 59/413 |
| 3,587,382 | 6/1971 | Boyd et al. | 83/652 |
| 3,826,170 | 7/1974 | Jones et al. | 83/652 |
| 3,837,252 | 9/1974 | Brassel | 83/679 |
| 3,893,238 | 7/1995 | Scholl | 30/289 |
| 3,969,564 | 7/1976 | Carder | 428/212 |
| 4,233,872 | 11/1980 | Jesser | 83/652 |
| 4,502,232 | 3/1985 | Broders | 33/174 |
| 4,505,039 | 3/1985 | Donovan | 30/289 |
| 4,646,439 | 3/1987 | Squires | 30/289 |
| 4,671,977 | 7/1987 | Berry | 428/62 |
| 4,813,141 | 3/1989 | Funger | 30/290 |
| 4,833,956 | 5/1989 | Roberts | 83/56 |
| 4,864,729 | 9/1989 | Funger | 30/290 |
| 5,010,650 | 4/1991 | Despins et al. | 30/304 |
| 5,079,842 | 1/1992 | Ward | 30/289 |

FOREIGN PATENT DOCUMENTS

WO9010526 9/1990 World Int. Prop. O. .

*Primary Examiner*—Richard K. Seidel
*Assistant Examiner*—Hwei-Siu Payer
*Attorney, Agent, or Firm*—John F. Bryan, Jr.

[57] ABSTRACT

A flattened base having a blade holding slot in the upper surface thereof and a steel-rule die type cutting blade mounted therein to protrude sufficiently for cutting through the backing of a pile carpet is configured for placement beneath carpet sections so that two such sections may be to cut to match for closely fitted hidden carpet seams.

3 Claims, 3 Drawing Sheets

CARPET SEAM CUTTER

FIELD OF THE INVENTION

The present invention relates to the field of carpet laying tools, and more particularly to tools used for cutting carpet sections to make hidden abutting seams, as is done at doorways to adjoining rooms or as when inletting decorative carpet borders or the like.

BACKGROUND AND SUMMARY OF THE INVENTION

Whether in a home, an office or a commercial setting, carpet is generally laid in sections that are cut from rolls and joined by virtually invisible hidden seams. Edge seams are made where a width greater than one roll is required. The carpet is folded back and cut by hand, following between backstitched rows of piling. The resulting straight edges are joined and the seam is then stretched and flattened. Although care must be exercised, these seams can be done by a helper under supervision. Outside edges, which are stretched onto a tacking strip, are less difficult and can be done without close supervision.

A higher degree of skill is required in making hidden end seams where two laid sections must abut, and a lead man or the crew foreman will do this work personally. This situation occurs most commonly at doorways between adjoining rooms or at closets. The long standing practice is to fold the first section so that the backing can be cut with a straight edge, and then to overlap the sections and carefully make a matching cut by eye. This is time consuming and even with care and skill, quality can be uncertain. It is difficult to cut the backings to match perfectly, and the tufted pile will either catch or avoid the blade so as to be "shaved" unevenly. An alternate method is to overlap the carpet sections and cut through both with a razor blade holding tool, using a straight edge as a guide. Because of the depth of the double thickness, the cuts do not necessarily match. Again, the tufted pile can be shaved unevenly and the effects conspire to make a visible, or "shaded" seam.

Donavan, U.S. Pat. No. 4,505,039, discloses a device, wherein a hinged guide has stops for engaging the edge of the underneath carpet section, and an upper plate which folds down to guide a blade in making a cut aligned with the under edge. Ward, PCT No. WO 90/10526 discloses another means for making a cut guided by the edge of an underlying carpet section. Other prior art by Funger, U.S. Pat. No. 4,813,141, discloses apparatus for making a guided cut through the overlapped sections wherein "thick", "thin" and "exactly even" cuts are taught to be obtained by either tilting the blade or holding it vertical. Squires, U.S. Pat. No. 4,646,439, discloses means for making a guided cut for abutting carpet borders and Roberts, U.S. Pat. No. 4,833,956 discloses a hand-held tool for cutting overlapped layers simultaneously to make a matching cuts for a seam.

These, and other tools have been offered to the carpet laying trade over the years, but skill and experience remain essential to making the undetectable hidden seam expected of quality work, and results are not certain. When cutting through the pile, a blade will either catch or avoid the tufts so that the pile may be shaved unevenly, making a seam which will show even when carpet backings are cut to match perfectly.

A first object of the present invention is therefore to provide a tool which will make perfectly matched cuts for carpet seams. A second object is to eliminate pile shaving and its revealing effect in carpet seams. A third object is to provide a tool capable of cutting carpet for an undetectable hidden seam without requisite skill or experience.

The present invention accomplishes the above objectives by providing an elongated blade, held in a fixed position beneath the carpet section to be cut. The cut is then made by urging the backing of the carpet into the blade. Thus, the blade cuts through the backing without being drawn through the carpet pile. In fact, the blade makes minimal pile contact, needing only to extend sufficiently to sever the backing. In cutting for a hidden seam, the blade is held in position at the desired seam location while two overlapped sections of laid carpet are cut as described, so that a perfectly matched cut is assured in both sections. The invention can be similarly used to cut carpet for inlet patterns or borders, and can be used to make a precisely trimmed carpet edge as required for hidden edges or the like. Furthermore, it is not limited to abutting end seams, but works equally well for edge seams and angled seams.

DESCRIPTION OF THE DRAWINGS

The aforementioned and other objects and features of the invention will be apparent from the following detailed description of specific embodiments thereof, when read in conjunction with the accompanying drawings, in which.

DETAILED DESCRIPTION OF THE DRAWINGS

Figure 1:
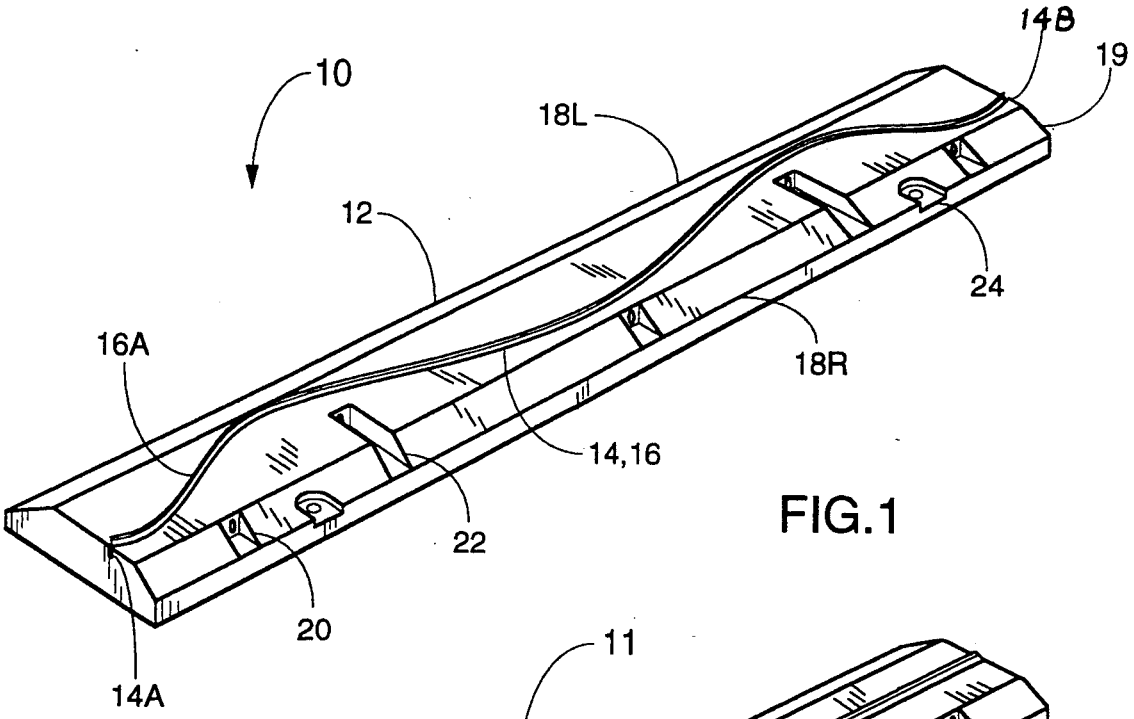
FIG. 1 is a view showing a preferred embodiment of the present invention.
Figure 2:
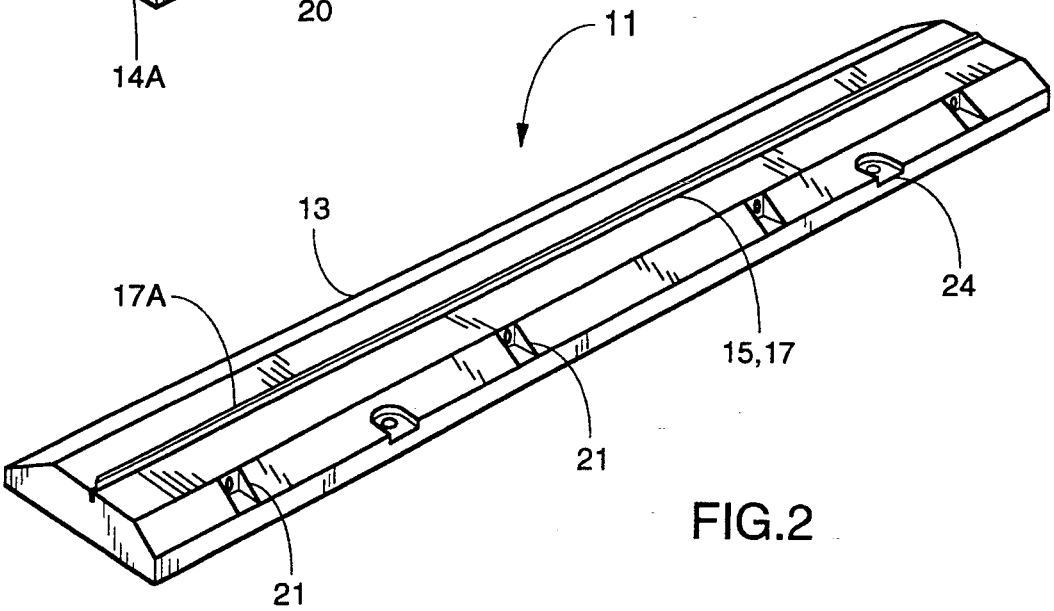
FIG. 2 shows the preferred embodiment with a straight cutting blade.
Figure 3:
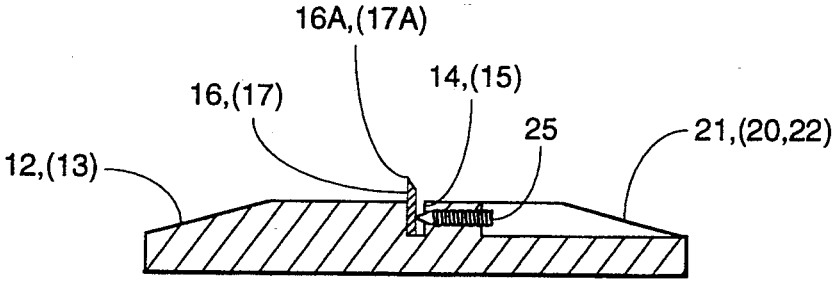
FIG. 3 is a cross-section view of either embodiment showing the blade mounting.

In FIG. 1 is shown cutting tool 10, the preferred embodiment of the present invention, comprising an elongated, flattened base 12 with beveled edges, a blade holding slot 14 having first end 14A and second end 14B, and an elongated, flexible steel rule die type blade 16. Blade 16 is mounted so that cutting edge 16A protrudes sufficiently to cut through the carpet backing, something less than $\frac{1}{8}''$, above the upper surface of base 12. The longitudinal edges 18L and 18R of base 12 are preferable beveled in the manner shown to facilitate the use of the invention as will be subsequently explained. Recessed holes 24, which are approximately $\frac{1}{8}''$ in diameter for reasons later described, permit base 12 to be fixed in position by means of carpet tacks if so desired by the user, although this is not needed in every case. Also seen are access slots 20 and extended access slots 22, which FIG. 3 shows in detail. A serpentine pattern for blade 16 is preferred because, all else being equal, a seam made in this manner will be less obvious to the eye than a straight cut seam. Flexible blade 16 conforms to the path of holding slot 14, and the preferred path is such that, when making an unusually long seam, base 12 can be repositioned longitudinally with first end 14A adjacent to the prior location of second end 14B, making a smooth, continuously curved cut. Cutting tool 11 of FIG. 2 is the same as the preferred embodiment, except that blade holding slot 15 is straight, for making seams in the usual straight-cut manner, rather than as shown in FIG. 1. Base 13, recessed holes 24 and access slots 21 of cutting tool 11 are otherwise either unchanged or similar to cutting tool 10. FIG. 3 shows a cross-section typical of either cutting tool 10 or 11. Here, cutting blade 16 or 17 is seen to be locked in slot 14 or 15 respectively by socket head set screws 25 at each access slot 20, 21 or 22.

Figure 4:
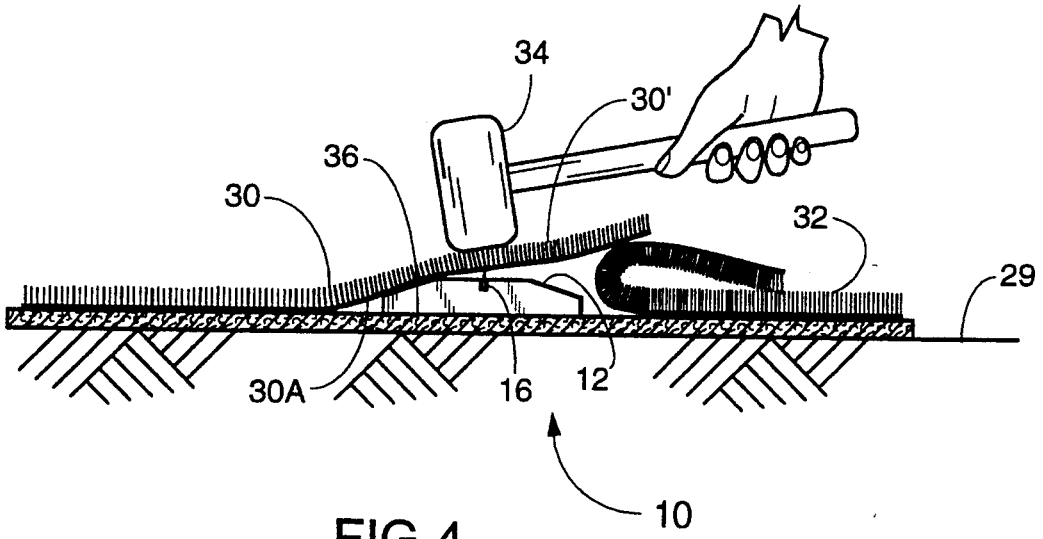
FIG. 4 is cross-sectional view of a first carpet section being cut with the present invention.
Figure 5:
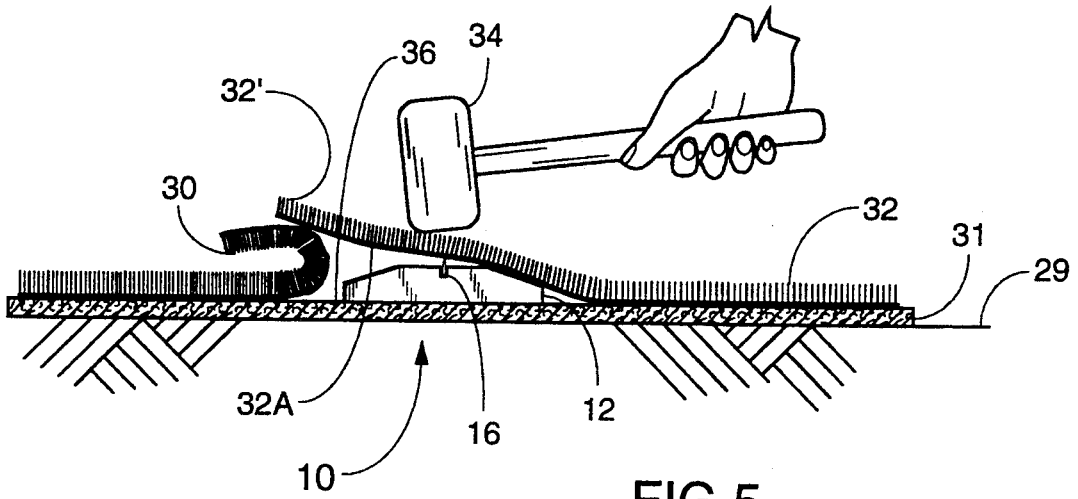
FIG. 5 is a cross-sectional view of a second carpet section being cut to fit with the first section thereof.

FIGS. 4 and 5 show the use of the present invention in making close fitting cuts for an abutted seam in overlapping carpet sections 30 and 32, which are laid on floor 29 and pad 31, as at a doorway to adjoining rooms. Cutting tool 10 or 11, according to the present invention, is placed on supporting surface 36, beneath carpet sections 30 and 32, and section 32 is folded back so that section 30 can be stretched to lay flat across blade 16 without significant planar displacement so as to avoid dimensional excess. Backing 30A is driven by hammer 34 against blade 16 to sever the seam excess portion 30' as is shown in FIG. 4 and the process is then repeated for carpet section 32 as is shown in FIG. 5, where seam excess portion 32' is severed. Hammer 34 is a conventional tool customarily used by every carpet layer, but a roller or some other means would also suffice to urge the backing 30A against blade 16. The slight dimensional excess occasioned by the thickness of cutting tool 10 causes the edges of cut sections 30 and 32 to be forced together when cutting tool 10 is removed, helping to make an undetectable hidden seam. In cases where the carpet backing is stiff and the carpet is tightly laid it is desirable to tack the base 12 in position with common carpet tacks through the recessed holes 24 shown in FIG. 1. Cutting tool 10 is, in each case, urged toward the carpet section being cut, to the limit of the clearance of recessed hole 24 on the carpet tack. This will provide approximately 1/16" adjustment of cut location, compensating for the above referenced dimensional excess when necessary.

Figure 6:
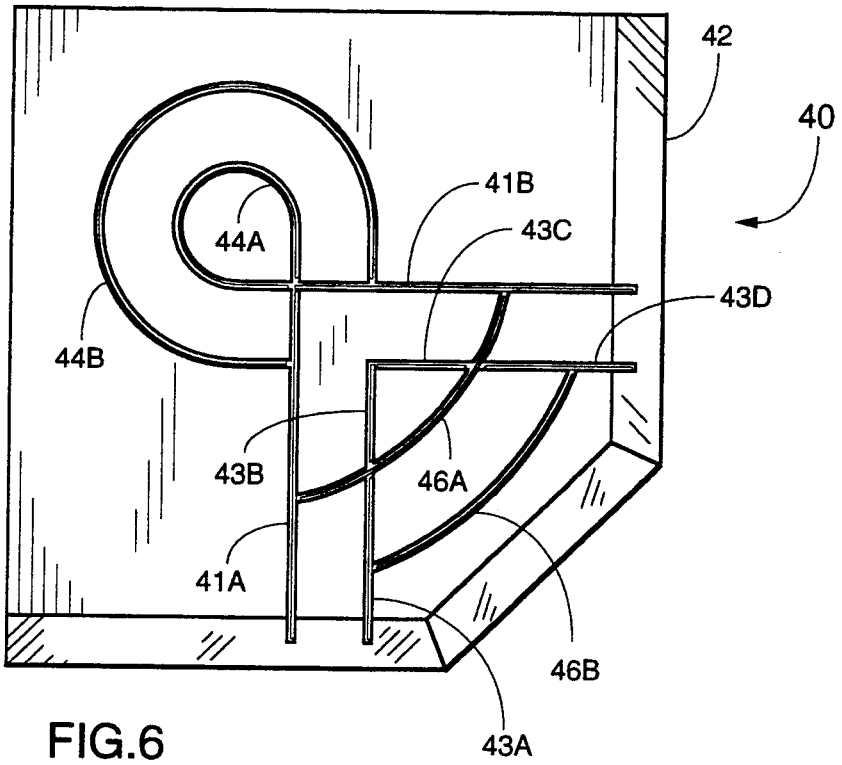
FIG. 6 is a view of an alternate embodiment of the invention as may be used for cutting inlet border corner patterns.

FIG. 6 shows a corner tool 40 as an alternate embodiment of the present invention for cutting inlet carpet patterns at the corners of decorative borders. Heretofore, straight portions of these borders have been measured and cut with a straight-edge, and templates have been used to outline the pattern for hand cutting the corners. Hand cutting corner patterns is tedious, so that skill and continuous concentration has been required to make quality corners. This process is greatly simplified by the use of corner tool 40, in the manner previously described, wherein the carpet is overlaid and the backing cut from the underside in a selected pattern. After cutting the carpet being laid, the inlet carpet portion is cut using the same blade pattern for a perfect fit. Flattened base 42, preferrably beveled in the manner of FIG. 1, holds blades 44A and 44B so as to be conformed to cut an external corner loop and blades 46A and 46B to cut an inwardly curved corner pattern. Straight blades 41A,B and 43A,B,C,D are arranged to cut the ends of the straight border portions and to make a square cut corner.

Figure 7:
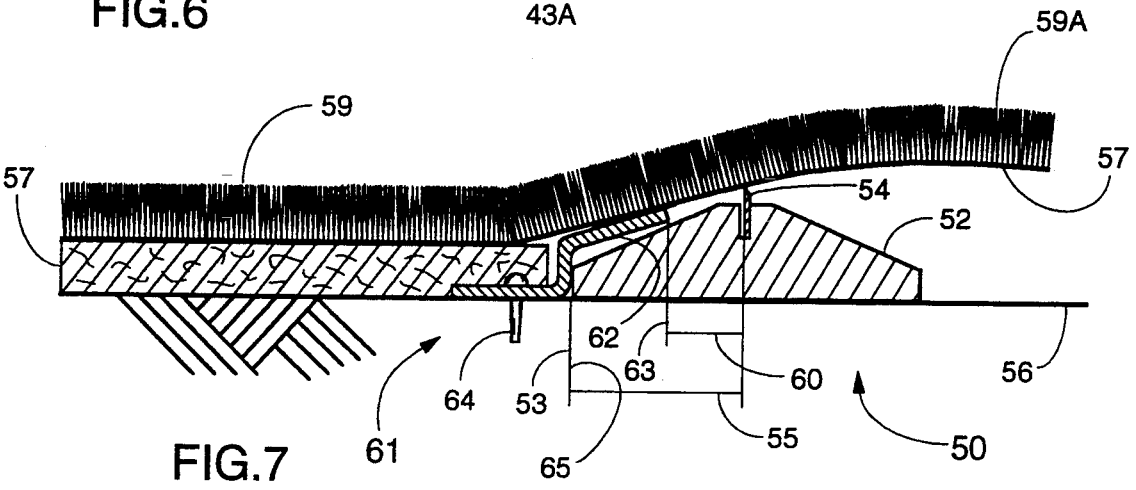
FIG. 7 is a view of another alternate embodiment of the present invention as used for making a hidden carpet edge.
Figure 8:
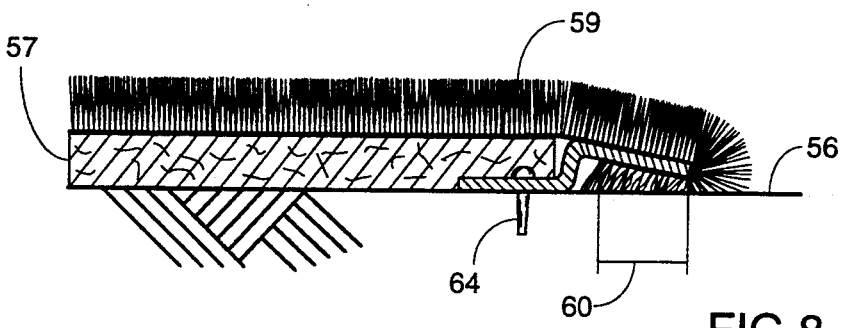
FIG. 8 is a view showing the finished hidden edge of FIG. 7.

Another common need in carpet laying addressed by the present invention is the making of a hidden edge, shown in FIG. 8, as is required at junctures of carpeted and tiled flooring. The making of such a hidden edge is shown in FIG. 7, where yet another alternate embodiment of the present invention, edge cutting tool 50, is shown. Hidden edges are made by use of a clamping piece 61, known in the trade as a "Zee-bar", which is fixed to floor 56 at the edge location 63 by tacks 64. Zee-bar open lip 62 is made to receive and clamp down on a predetermined, tucked under, width of carpet 60, as is shown in the following FIG. 8. Carpet pad 57 is cut to lie flush against the closed side of Zee-bar 61 and carpet 59 is laid with an excess portion 59A extending well beyond edge location 63. Edge tool 50, comprising base 52 which holds blade 54 parallel relative to reference base edge 53 at an appropriate dimension 55, is placed with base reference edge 53 against Zee-bar 61 at surface 65. Carpet 59 is then cut along blade 54 as is previously described and excess portion 59A is removed. The appropriate dimension 55 provides the predetermined width 60, which in actual practice is about ¾", to be folded and tucked under the Zee-bar open lip 62, which is then flattened to clamp predetermined carpet width 60, thereby providing the finished hidden edge shown in FIG. 8.

It is to be understood that the present invention is not limited to the disclosed embodiments, but is capable of rearrangement, modification and substitution of parts within the spirit of the invention.

I claim:

1. Apparatus for cutting the backing of a section of pile carpet laid on a supporting surface so as to make a hidden edge, said apparatus comprising;

hidden edge clamping means affixed to the supporting surface and having a closing means for clamping a folded predetermined width of carpet edge;

an elongate blade including a longitudinal cutting edge;

base means having a flattened shape with upper and lower surfaces for placement beneath a carpet section and having a straight reference edge for placement against said clamping means;

means for affixing said elongate blade at said upper surface so that said cutting edge protrudes thereabove by a dimension at least equal to the thickness of the carpet backing to be cut with said blade edge being parallel to said reference edge at a dimension for cutting said predetermined width; and means, opposed to said cutting edge to cooperate therewith, for urging the backing of said pile carpet section against said cutting edge to cut through said backing while said reference edge cooperates with said clamping means so as to provide said predetermined width of carpet for clamping by said closing means.

2. Apparatus for cutting the backing of two overlapped sections of pile carpet to make a hidden, abutting seam, said apparatus comprising;

an elongate, flexible steel rule die blade with an elongate cutting edge;

base means having a flattened shape with upper and lower surfaces for placement at a selected seam location, beneath overlapped carpet sections, with minimal planar displacement thereof;

means for affixing said elongate blade at said upper surface and conforming said blade to a cutting path so that said cutting edge protrudes above said upper surface by a dimension at least equal to the thickness of the carpet backing to be cut; and means, opposed to said cutting edge to cooperate therewith, for separately urging the backings of said overlapped sections in turn against said cutting edge so as to cut through each said backing at the selected seam location, said cuts, by virtue of aforesaid minimal planar displacement, making a smoothly abutting seam at the selected seam location.

3. Apparatus for cutting the backing of first and second sections of pile carpet to cut an inlet pattern with a hidden, abutting seam, said apparatus comprising;

an elongate, flexible steel rule die blade with a longitudinal cutting edge;

base means having a flattened shape with upper and lower surfaces for placement beneath a carpet section at a selected seam location with minimal planar displacement of the carpet;

means for affixing said elongate blade at said upper surface and for conforming said blade to the inlet pattern to be cut so that said cutting edge protrudes above said upper surface by a dimension at least equal to the thickness of the carpet backing to be cut; and means, opposed to said cutting edge to cooperate therewith, for separately urging the backings of said first and second sections of pile carpet in turn against said cutting edge and cutting through each said backing so as to cut the inlet pattern in both first and second carpet sections which, by virtue of aforesaid minimal planar displacement, make a smoothly abutting seam therebetween.

* * * * *